US008981669B2

(12) United States Patent
Chen et al.

(10) Patent No.: US 8,981,669 B2
(45) Date of Patent: Mar. 17, 2015

(54) LAMPS AND CONTROL CIRCUIT

(71) Applicant: Lextar Electronics Corporation, Hsinchu (TW)

(72) Inventors: Chun-Kuang Chen, Taipei (TW); Feng-Ling Lin, Pingtung (TW); Po-Shen Chen, New Taipei (TW); Hui-Ying Chen, Hemei Township (TW); Tung-Yu Chen, Tainan (TW)

(73) Assignee: Lextar Electronics Corporation, Hsinchu (TW)

( * ) Notice: Subject to any disclaimer, the term of this patent is extended or adjusted under 35 U.S.C. 154(b) by 230 days.

(21) Appl. No.: 13/653,560

(22) Filed: Oct. 17, 2012

(65) Prior Publication Data

US 2013/0093344 A1 Apr. 18, 2013

(30) Foreign Application Priority Data

Oct. 18, 2011 (TW) ..... 100137648 A

(51) Int. Cl.
*H05B 37/02* (2006.01)
*H05B 33/08* (2006.01)

(52) U.S. Cl.
CPC ..... *H05B 33/086* (2013.01)
USPC ..... 315/294; 315/297; 315/307

(58) Field of Classification Search
CPC ..... H05B 41/3927; H05B 41/3922; G09G 2320/041
USPC ..... 315/291, 294, 297, 307–309
See application file for complete search history.

(56) References Cited

U.S. PATENT DOCUMENTS

| | | | | |
|---|---|---|---|---|
| 7,573,209 | B2 * | 8/2009 | Ashdown et al. | 315/307 |
| 7,573,210 | B2 * | 8/2009 | Ashdown et al. | 315/307 |
| 8,044,612 | B2 * | 10/2011 | Prendergast et al. | 315/318 |
| 2008/0252197 | A1 | 10/2008 | Li et al. | |
| 2010/0315012 | A1 * | 12/2010 | Kim et al. | 315/185 R |
| 2011/0018465 | A1 * | 1/2011 | Ashdown | 315/294 |
| 2011/0234113 | A1 | 9/2011 | Ku et al. | |
| 2011/0260633 | A1 | 10/2011 | Takeda et al. | |

FOREIGN PATENT DOCUMENTS

WO WO 2011/093395 A1 8/2011

* cited by examiner

*Primary Examiner* — Jason M Crawford
(74) *Attorney, Agent, or Firm* — Moser Taboada

(57) ABSTRACT

An embodiment of the invention provides a lamp comprising a first emitting device, a second emitting device, and a control signal generation device. The control signal generation device generates a first control signal and a second control signal to control the first emitting device and the second emitting device, so that a first light flux generated by the first emitting device is equivalent to a second light flux generated by the second emitting device, wherein the second control signal is generated according to the first control signal.

19 Claims, 7 Drawing Sheets

LAMPS AND CONTROL CIRCUIT

RELATED APPLICATIONS

This application claims priority to Taiwan Application Serial Number 100137648, filed Oct. 18, 2011, which is herein incorporated by reference.

BACKGROUND

1. Field of Invention

The invention relates to a lamp. More particularly the invention relates to a lamp having color temperature adjustment.

2. Description of Related Art

Light emitting diodes used in electronic components in the past have been widely used in lighting products currently. Since the light emitting diodes have excellent electrical property and structural feature, a demand for the light emitting diodes has been increased gradually. Compared to fluorescent lamps and incandescent lamps, white LEDs have attracted great attention. However, corresponding to different demands of users, a lamp which can meet the demand for generating lights with different color temperatures is generated consequently. However, the color temperatures of conventional LEDs have been determined before leaving the factory and can not be changed. If users have a demand for lights with different color temperatures, the demand can only be solved by replacing LEDs having different color temperatures. This is inconvenient for users.

SUMMARY

The invention provides a lamp or lighting system capable of controlling a color temperature.

The invention provides a control circuit, which can control emitting devices with different color temperatures in a lamp, and the color temperature of the whole lamp is adjusted through a control signal outputted by the control circuit.

The control circuit provided by the invention only requires a single control signal generator, and then at least two different control signals are generated by other circuits, to decrease the layout area and cost of the control circuit.

Other purposes and advantages of the invention may be further understood from the technical characteristics disclosed by the invention.

For realizing one purpose or a part of or all of the purposes described above or other purposes, an embodiment of the invention provides a lamp, including a first emitting device, a second emitting device and a control signal generation device. The control signal generation device generates a first control signal and a second control signal to control the first emitting device and the second emitting device, so that a first light flux generated by the first emitting device is equivalent to a second light flux generated by the second emitting device, wherein the second control signal is generated according to the first control signal.

A further embodiment of the invention provides a control circuit for controlling a color temperature of a lamp, which includes a pulse signal generation device, a buffer device, an inverter and a compensation device. The pulse signal generation device generates a first control signal. The buffer device receives and buffers the first control signal. The inverter receives the first control signal to generate an inverted first control signal. The compensation device receives a compensation signal and the inverted first control signal to generate the second control signal. The first control signal controls a first emitting device in the lamp. The second control signal controls a second emitting device in the lamp.

DETAILED DESCRIPTION

The foregoing and other technical contents, features and functions of the invention may be clearly shown in the following detailed description of a preferred embodiment with reference to the drawings. Directional terms mentioned in the following embodiments, such as up, down, left, right, front or back, only refer to the directions of the accompany drawings. Therefore, the directional terms used herein are only used to illustrate the invention and are not limitative.

Figure 1:
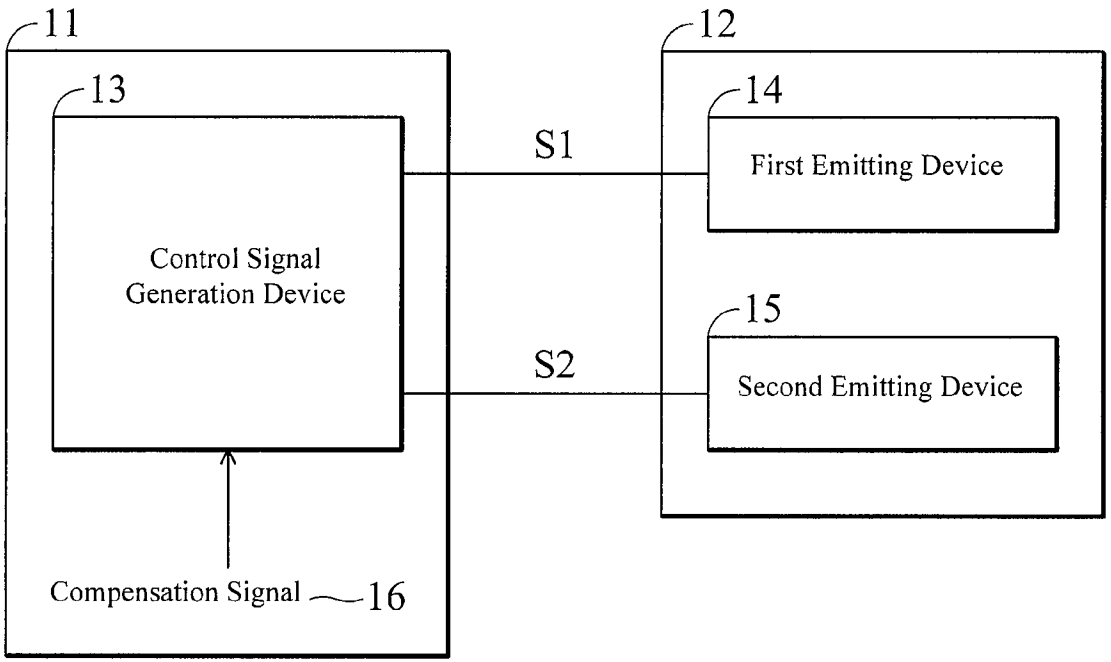
FIG. 1 is a schematic view of a lamp according to an embodiment of the invention.
Figure 2:
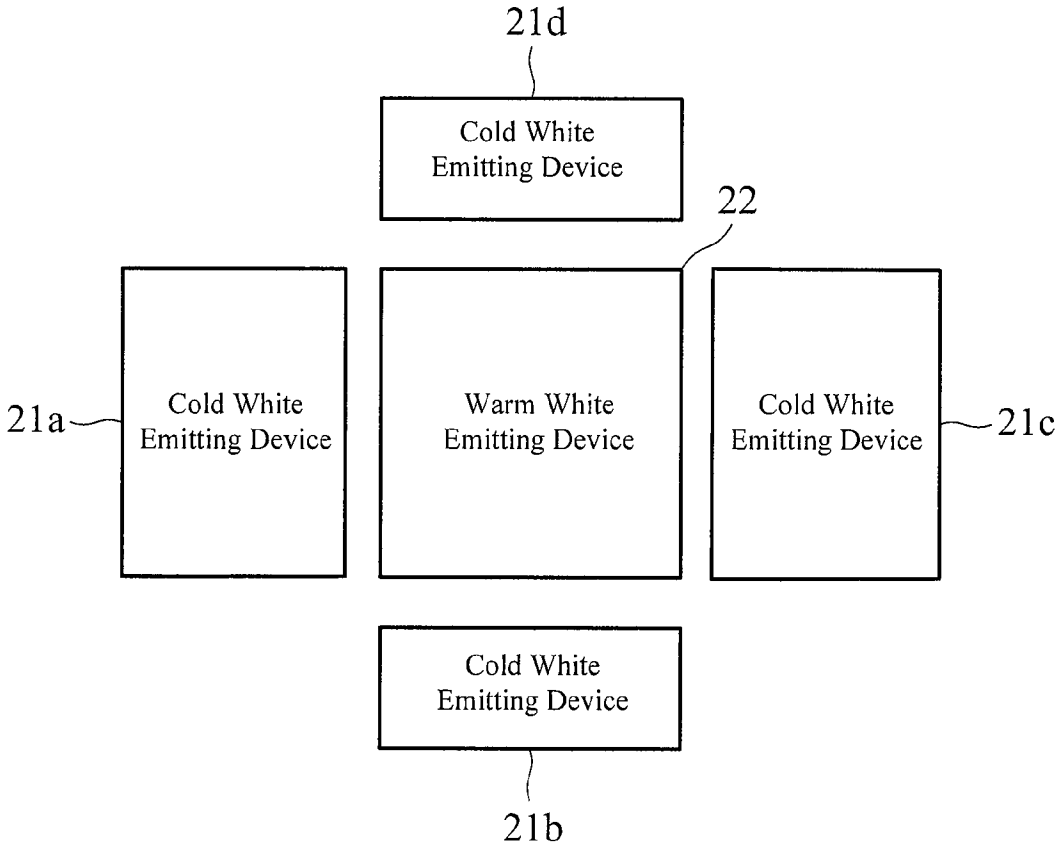
FIG. 2 is a schematic view of an emitting module.

FIG. 1 is a schematic view of a lamp according to an embodiment of the invention. The lamp includes a control circuit 11 and an emitting module 12. The emitting module 12 includes a first emitting device 14 and a second emitting device 15. The first emitting device 14 is a cold white emitting device. The second emitting device 15 is a warm white emitting device. In the embodiment, the first emitting device 14 and the second emitting device 15 may include one LED or a plurality of LEDs. In the embodiment, the emitting module 12 only takes two emitting devices with different color temperatures for examples for illustration, but the invention is not limited to this. The emitting module 12 may include more than two emitting devices. Each emitting device has a different color temperature. Then, the control circuit 11 controls different emitting devices to change the color temperature of the lamp. The arrangement of the first emitting device 14 and the second emitting device 15 in the emitting module 12 may have some variations according to a demand of a designer. Referring to FIG. 2, FIG. 2 is a schematic view of an emitting module. The emitting module shown in FIG. 2 is a flat emitting module with chip on board (COB). The emitting devices 21*a*, 21*b*, 21*c* and 21*d* are cold white emitting devices. The emitting device 22 is a warm white emitting device. The cold white emitting devices 21*a*, 21*b*, 21*c* and 21*d* are distributed around the warm white emitting device 22. Then, the control circuit controls the turn-on and turn-off of the cold white emitting devices and the warm white emitting device for changing the color temperatures.

The control circuit 11 includes a control signal generation device 13. The control signal generation device 13 generates a first control signal S1 and a second control signal S2 to control the first emitting device 14 and the second emitting device 15, wherein the second control signal S2 is generated according to the first control signal S1 and a compensation signal 16. The control circuit 11 may adjust the amplitude and duty cycle of the first control signal S1 and the second control signal S2 to control the brightness and turn-on time of the first emitting device 14 and the second emitting device 15. In the embodiment, the emitting efficiency of the first emitting device 14 is different from the emitting efficiency of the second emitting device 15; for example, the first emitting efficiency is greater than the second emitting efficiency. Therefore, the compensation signal 16 may be generated according to a difference between a first emitting efficiency of the first emitting device 14 and a second emitting efficiency of the second emitting device 15, and then the second control signal S2 is generated through the compensation signal 16 and the first control signal S1. By means of the above-mentioned control signal generation mode, a first light flux generated by the first emitting device 14 may be equivalent to a second light flux generated by the second emitting device 15.

Figure 3:
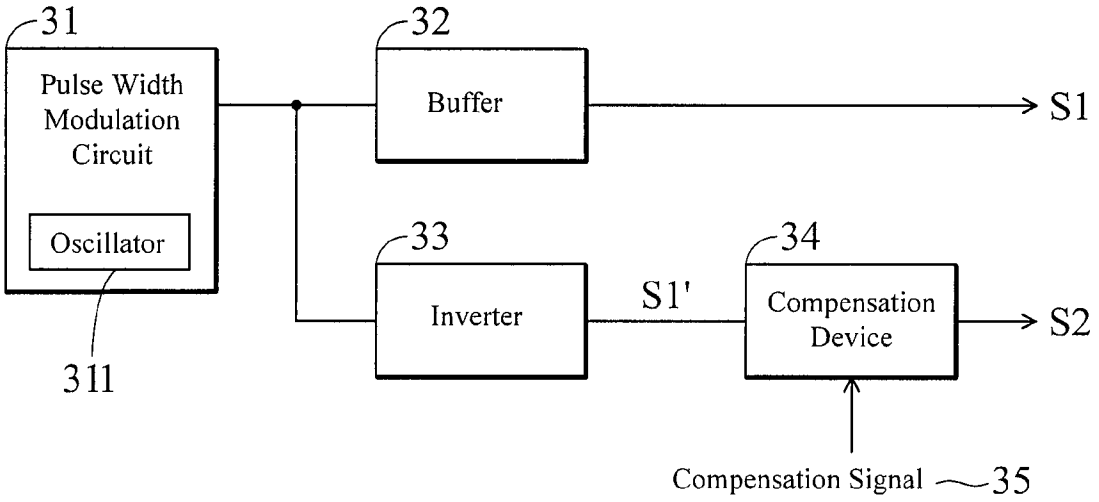
FIG. 3 is a schematic view of a control circuit according to an embodiment of the invention.

FIG. 3 is a schematic view of a control circuit according to an embodiment of the invention. The control circuit includes a pulse signal generation device 31 (e.g., a pulse width modulation (PWM) circuit), a buffer 32, an inverter 33 and a compensation device 34. The control circuit outputs the first control signal S1 and the second control signal S2 at the same time to control a first emitting device and a second emitting device. The pulse signal generation device 31 generates the first control signal S1, wherein the duty cycle of the first control signal S1 is determined according to a color temperature. The pulse signal generation device 31 comprises an oscillator 311, and the duty cycle of the first control signal is predetermined. The first control signal S1 is transferred to the buffer 32 and the inverter 33 respectively. The buffer 32 delays a predetermined time of the first control signal S1, so that the first control signal S1 outputted by the buffer 32 is synchronized with the second control signal S2 outputted by the compensation device 34. The predetermined time may be determined according to the processing speed of the inverter 33 and the compensation device 34. The inverter 33 makes an inverted processing to the first control signal S1 to generate and transfer an inverted first control signal S1' to the compensation device 34. The compensation device 34 outputs the second control signal S2 after it receives the inverted first control signal S1' and a compensation signal 35. In the embodiment, the emitting efficiency of the first emitting device is different from the emitting efficiency of the second emitting device. In order to make the light flux generated by the first emitting device equivalent to the light flux generated by the second emitting device, the compensation device 34 may modify the inverted first control signal S1' according to the compensation signal 35 for reaching the foregoing purpose. In the embodiment, the compensation signal 35 is generated according to a difference between the emitting efficiency of the first emitting device and the emitting efficiency of the second emitting device. In the embodiment, the first emitting device is the cold white emitting device, and the second emitting device is the warm white emitting device. Since the emitting efficiency of the warm white emitting device is poorer, the compensation device 34 compensates the insufficient part of the emitting efficiency of the warm white emitting device. However, those skilled in the art also may design the compensation device 34 for changing the first control signal S1 transferred to the cold white emitting device so as to decrease the excessive part of the emitting efficiency of the cold white emitting device. In one embodiment, the compensation device 34 is a DC level adjustment circuit, the compensation signal is a DC bias compensation value, and the compensation device 34 adjusts a low voltage level of the inverted first control signal according to the DC bias compensation value.

Figure 4:
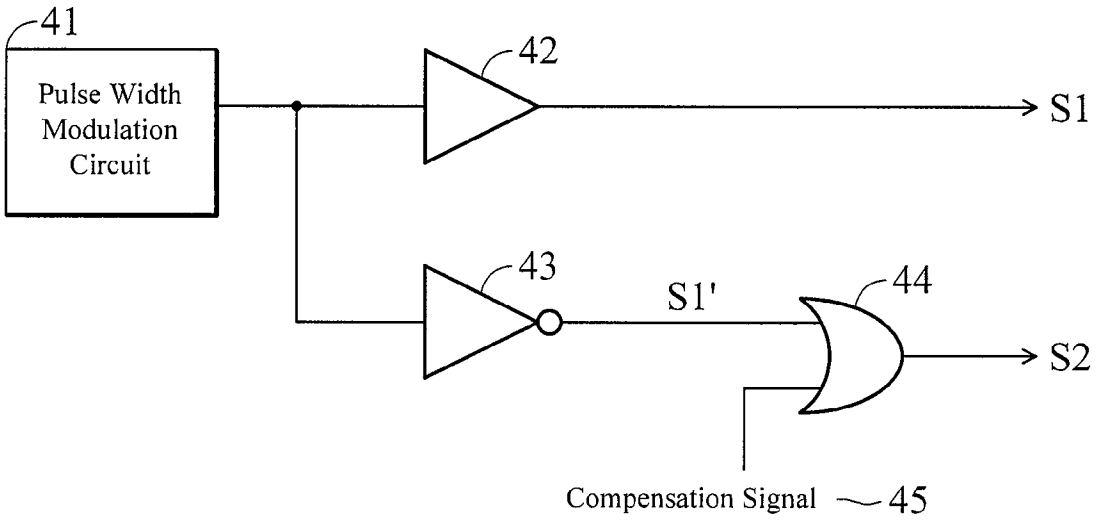
FIG. 4 is a schematic view of a control circuit according to a further embodiment of the invention.

FIG. 4 is a schematic view of a control circuit according to a further embodiment of the invention. The control circuit includes a pulse signal generation device 41 (e.g., a PWM circuit), a buffer 42, an inverter 43 and an OR gate 44. The control circuit outputs the first control signal S1 and the second control signal S2 at the same time to control a first emitting device and a second emitting device. The pulse signal generation device 41 generates the first control signal S1, wherein the duty cycle of the first control signal S1 is determined according to a color temperature. The first control signal S1 is transferred to the buffer 42 and the inverter 43 respectively. The buffer 42 delays a predetermined time of the first control signal S1, so that the first control signal S1 outputted by the buffer 42 is synchronized with the second control signal S2 outputted by the OR gate 44. The predetermined time may be determined according to the processing speed of the inverter 43 and the OR gate 44. The inverter 43 makes the inverted processing to the first control signal S1 to generate and transfer an inverted first control signal S1' to the OR gate 44. The OR gate 44 makes an OR operation after it receives the inverted first control signal S1' and a compensation signal 45 to output the second control signal S2. In the embodiment, the emitting efficiency of the first emitting device is different from the emitting efficiency of the second emitting device. In order to make the light flux generated by the first emitting device equivalent to the light flux generated by the second emitting device, the OR gate 44 may modify the inverted first control signal S1' according to the compensation signal 45 for reaching the foregoing purpose. In the embodiment, the compensation signal 45 is generated according to a difference between the emitting efficiency of the first emitting device and the emitting efficiency of the second emitting device. In the embodiment, the first emitting device is the cold white emitting device, and the second emitting device is the warm white emitting device. Since the emitting efficiency of the warm white emitting device is poorer, the OR gate 44 makes the OR operation to the inverted first control signal S1' and a compensation signal 45 for compensating the insufficient part of the emitting efficiency of the warm white emitting device. However, those skilled in the art also may design the OR gate 44 for changing the first control signal S1 transferred to the cold white emitting device so as to decrease the excessive part of the emitting efficiency of the cold white emitting device.

Figure 5:
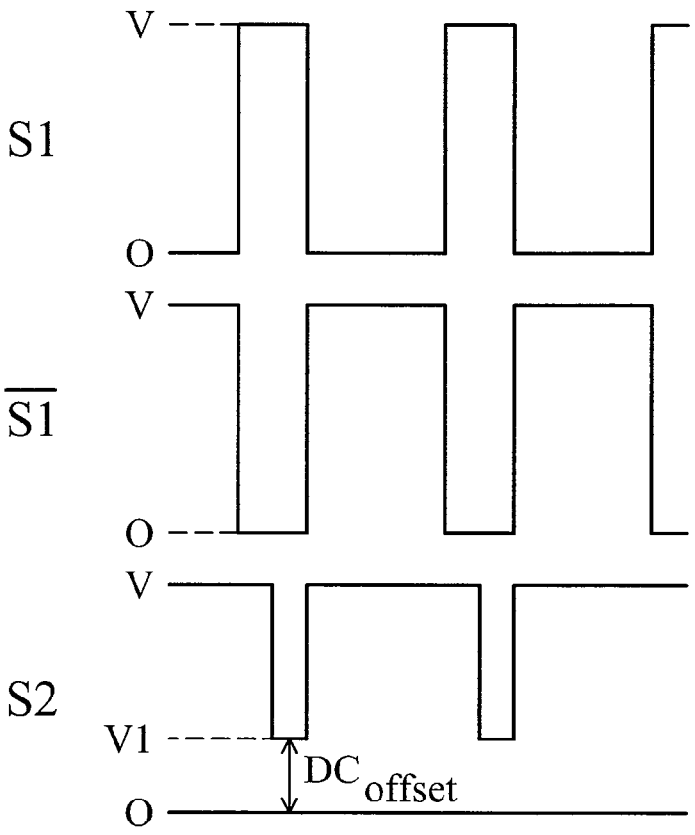
FIG. 5 is a schematic view of a control signal generated according to an embodiment of the invention.
Figure 6:
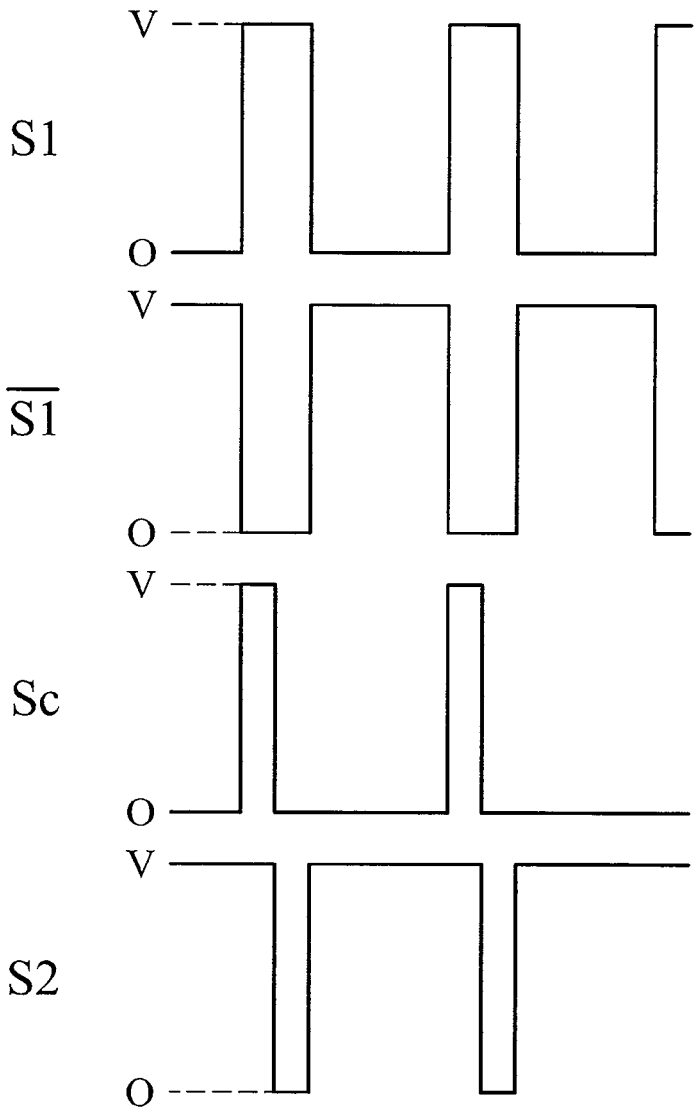
FIG. 6 is a schematic view of a control signal generated according to a further embodiment of the invention.

In order to illustrate the operation of the first control signal, the second control signal and the compensation signal more clearly, FIGS. 5 and 6 are referred to. FIG. 5 is a schematic view of a control signal generated according to an embodiment of the invention. After the control signal generation device outputs the first control signal S1, firstly an inverter makes the inverted processing to the first control signal S1 for generating the inverted first control signal $\overline{S1}$. Then, a compensator may generate a DC voltage offset according to a difference between the emitting efficiency of two emitting devices. Afterwards, the compensator adjusts the low voltage level of the inverted first control signal $\overline{S1}$ to a voltage V1 according to the DC voltage offset for generating the second control signal S2. In such a way, the second emitting device with a lower emitting efficiency may generate a light flux equivalent to the light flux of the first emitting device.

FIG. 6 is a schematic view of a control signal generated according to a further embodiment of the invention. After the control signal generation device outputs the first control signal S1, firstly an inverter makes the inverted processing to the first control signal S1 for generating the inverted first control signal $\overline{S1}$. Then, a compensation signal Sc is generated according to a difference between the emitting efficiency of the first emitting device and the emitting efficiency of the second emitting device. Afterwards, the compensator makes the OR operation to the inverted first control signal $\overline{S1}$ and the compensation signal Sc for generating the second control signal S2. In such a way, the second emitting device with a lower emitting efficiency may generate a light flux equivalent to the light flux of the first emitting device.

Figure 7:
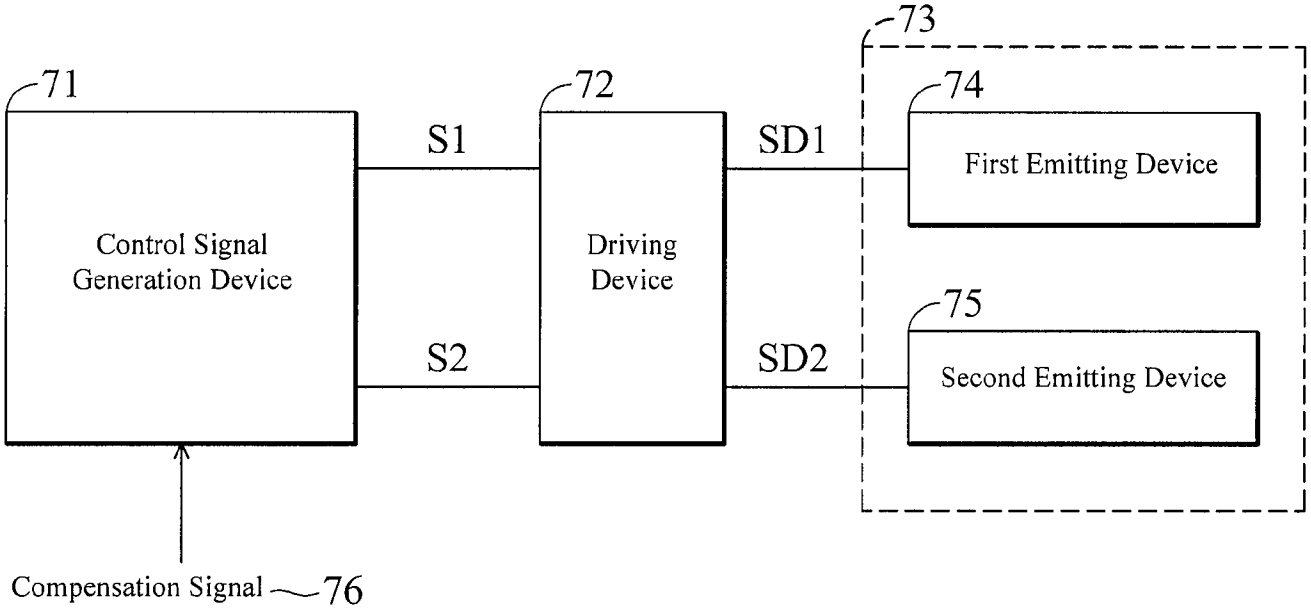
FIG. 7 is a schematic view of a lamp according to a further embodiment of the invention.

FIG. 7 is a schematic view of a lamp according to a further embodiment of the invention. The lamp includes a control signal generation device 71, a driving circuit 72 and an emitting module 73. The emitting module 73 includes a first emitting device 74 and a second emitting device 75. The first emitting device 74 is a cold white emitting device. The second emitting device 75 is a warm white emitting device. In the embodiment, the first emitting device 74 and the second emitting device 75 may include one LED or a plurality of LEDs. In the embodiment, the emitting module 73 only takes two emitting devices with different color temperatures for example, but the invention is not limited to this. The emitting module 73 may include more than two emitting devices. Each emitting device has a different color temperature. Then, the control circuit 71 controls the driving device 72 to drive different emitting devices for changing the color temperature of the lamp.

The control signal generation device 71 generates a first control signal S1, and a second control signal S2 is generated according to the first control signal S1 and a compensation signal 76. The driving device 72 outputs a corresponding first driving signal SD1 and a second driving signal SD2 after it receives the first control signal S1 and the second control signal S2 so as to drive the first emitting device 74 and the second emitting device 75. The control signal generation device 71 may adjust the amplitude and duty cycle of the first control signal S1 and the second control signal S2 to change the voltage, current or turn-on time of the first driving signal SD1 and the second driving signal SD2, thereby controlling the brightness and turn-on time of the first emitting device 74 and the second emitting device 75. In the embodiment, the emitting efficiency of the first emitting device 74 is different from the emitting efficiency of the second emitting device 75. Therefore, the compensation signal 76 may be generated according to a difference between a first emitting efficiency of the first emitting device 74 and a second emitting efficiency of the second emitting device 75, and then the second control signal S2 is generated through the compensation signal 76 and the first control signal S1. The driving circuit 72 is controlled by means of the above-mentioned control signal generation mode, so that a first light flux generated by the first emitting device 74 is equivalent to a second light flux of the second emitting device 75.

The above-mentioned descriptions are only preferred embodiments of the invention, and the implementation scope of the invention can not be limited to this. That is, all simple equivalent variations and modifications generally made according to the claims and the summary of the invention still fall within the scope of the invention. Additionally, any embodiment or the claims of the invention are not necessary to reach all purposes, advantages or features disclosed by the invention. Moreover, the abstract and the title are only used for assisting to search a patent document, and are not intended to limit the claims of the invention.

What is claimed is:

1. A lamp, comprising:

a first emitting device having a first emitting efficiency;

a second emitting device having a second emitting efficiency; and a control signal generation device for generating a first control signal and a second control signal to control the first emitting device and the second emitting device, so that a first light flux generated by the first emitting device is equivalent to a second light flux generated by the second emitting device, wherein the second control signal is generated according to the first control signal, and the first emitting efficiency is greater than the second emitting efficiency, wherein the control signal generation device comprises: a pulse signal generation device for generating the first control signal; a buffer device for receiving and buffering the first control signal; an inverter for receiving the first control signal to generate an inverted first control signal; and a compensation device for receiving a compensation signal and the inverted first control signal to generate the second control signal.

2. The lamp of claim 1, wherein the control signal generation device further receives the compensation signal and the second control signal is adjusted according to the compensation signal.

3. The lamp of claim 2, wherein the compensation signal is generated according to a difference between the first emitting efficiency and the second emitting efficiency.

4. The lamp of claim 1, wherein the compensation device is an OR gate.

5. The lamp of claim 1, wherein the pulse signal generation device comprises an oscillator, and a duty cycle of the first control signal is predetermined.

6. The lamp of claim 5, wherein the duty cycle is determined according to a color temperature of the lamp.

7. The lamp of claim 1, wherein the buffer device is used for synchronizing the first control signal with the second control signal.

8. The lamp of claim 1, wherein the compensation device is a DC level adjustment circuit, the compensation signal is a DC bias compensation value, and the compensation device adjusts a low voltage level of the inverted first control signal according to the DC bias compensation value.

9. The lamp of claim 1, wherein the first emitting device is a cold white emitting device, and the second emitting device is a warm white emitting device.

10. The lamp of claim 1, further comprising a driving device, wherein the driving device generates a first driving signal and a second driving signal according to the first control signal and the second control signal to drive the first emitting device and the second emitting device.

11. A control circuit for controlling a color temperature of a lamp, comprising:

a pulse signal generation device for generating a first control signal;

a buffer device for receiving and buffering the first control signal;

an inverter for receiving the first control signal to generate an inverted first control signal; and a compensation device for receiving a compensation signal and the inverted first control signal to generate the second control signal, wherein the first control signal controls a first emitting device in the lamp and the second control signal controls a second emitting device in the lamp.

12. The control circuit of claim 11, wherein the compensation signal is generated according to emitting efficiency of the first emitting device and the second emitting device.

13. The control circuit of claim 11, wherein the compensation device is an OR gate.

14. The control circuit of claim 11, wherein the pulse signal generation device comprises an oscillator, and a duty cycle of the first control signal is set according to the color temperature.

15. The control circuit of claim 11, wherein the buffer device is used for synchronizing the first control signal with the second control signal.

16. The control circuit of claim 11, wherein the compensation signal is generated according to a difference between a first emitting efficiency of the first emitting device and a second emitting efficiency of the second emitting device.

17. The control circuit of claim 11, wherein the compensation device is a DC level adjustment circuit, the compensation signal is a DC bias compensation value, and the compensation device adjusts a low voltage level of the inverted first control signal according to the DC bias compensation value.

18. The control circuit of claim 11, wherein the first emitting device is a cold white emitting device, and the second emitting device is a warm white emitting device.

19. The control circuit of claim 11, further comprising a driving device for receiving the first control signal and the second control signal to drive the first emitting device and the second emitting device.

* * * * *